US005117520A

United States Patent [19]

Larson

[11] Patent Number: 5,117,520

[45] Date of Patent: Jun. 2, 1992

[54] BED COVERING SECUREMENT SYSTEM

[76] Inventor: Lynn D. Larson, 1052 N. Lakeshore Dr., Lincoln, Nebr. 68528

[21] Appl. No.: 675,683

[22] Filed: Mar. 27, 1991

[51] Int. Cl.[5] ..... A47C 21/02

[52] U.S. Cl. ..... 5/508; 5/451; 5/498; 5/460

[58] Field of Search ..... 5/451, 460, 498, 508; 24/72.5

[56] References Cited

U.S. PATENT DOCUMENTS 512,966 1/1894 Jacobs ..... 5/498
4,301,561 11/1981 McLeod ..... 5/498 X
4,488,323 12/1984 Colburn ..... 5/460
4,930,172 6/1990 Johenning ..... 5/460 X
5,005,237 4/1991 Luchonok ..... 5/451 X

*Primary Examiner*—Michael F. Trettel
*Attorney, Agent, or Firm*—John A. Beehner

[57] ABSTRACT

A bed covering securement system for a waterbed mattress includes a friction strip secured to the bed covering engagement surface of the peripheral sidewall of a waterbed liner. The friction strip is of a shape and material such that the coefficient of friction between the strip and bed coverings is greater than the coefficient of friction between the liner sidewall and bed coverings.

14 Claims, 3 Drawing Sheets

BED COVERING SECUREMENT SYSTEM

BACKGROUND OF THE INVENTION

The present invention is directed generally to an apparatus and method for securing bed coverings onto a waterbed mattress supported on a liner within a frame and more particularly to such a liner equipped with a friction strip on the bed covering engagement surface thereof.

Waterbeds generally are preferred by sleepers because of the more restful sleep experienced on a waterbed mattress surface which substantially reduces the stress points associated with a body resting on a conventional mattress surface. A problem associated with waterbed mattresses, however, is that the bed coverings are somewhat susceptible to unintentional dislodgement from the mattress. This is because the bed coverings are usually simply tucked in the vertical space between the mattress and liner, or between the liner and frame without being tucked beneath the mattress itself. This is due both to the weight of the mattress, as well as to the somewhat restricted access caused by the peripheral support frame for the mattress.

Accordingly, a primary object of the invention is to provide an improved bed covering securement system for a waterbed.

Another object is to provide a bed covering securement system which includes a modified waterbed mattress liner.

Another object is to provide a bed covering securement system wherein a friction strip is simply secured to the bed covering engagement surface of any of the various types of commercially available waterbed mattress liners.

Another object is to provide a bed covering securement system which is operative to releasably secure the bed covering along all four sides of a waterbed mattress.

Another object is to provide a bed covering securement system which does not require any change in the manner of fitting bed coverings onto a waterbed mattress.

Finally, another object is to provide a bed covering securement system which is simple and rugged in construction, economical to manufacture and efficient in operation.

SUMMARY OF THE INVENTION

The bed covering securement system of the invention is directed to an improved waterbed mattress liner having a friction strip secured thereon for frictionally, but releasably securing bed coverings on a waterbed mattress.

A waterbed mattress liner has a bottom wall and an upstanding peripheral sidewall. Depending upon the type of liner, the bed coverings are either pressed into the slot formed between the mattress and interior surface of the sidewall, or in the slot between the exterior surface of the sidewall and the mattress frame. Whichever surface of the liner sidewall engages the bed coverings would be considered the bed covering engagement surface.

The friction strip of the invention is of a shape and material such that the coefficient of friction between the strip and bed coverings is greater than the coefficient of friction between the liner sidewall and the bed coverings thereby to releasably grip the bed coverings. Accordingly, a greater force is required to withdraw the bed coverings from the space adjacent the bed covering engagement surface of the liner sidewall. The friction strip is preferably secured to the liner, either directly by an adhesive or indirectly by being adhered to a vinyl backing sheet which is then heat sealed to the liner sidewall.

The friction strip is preferably a continuous elongated strip of a synthetic rubber-like compound which extends around the full periphery of the bed covering engagement surface of the liner sidewall. The strip may be extruded in a form which has a flat engagement surface on one side and an opposite roughened friction surface. The roughened surface may have ridges extended longitudinally across the length of the strip. An elongated generally sawtooth pattern is used in a preferred embodiment.

The invention also contemplates a method for releasably securing bed coverings on a waterbed mattress, including providing the friction strip of the invention, securing the strip to the bed covering engagement surface of the liner sidewall and fitting bed coverings onto the mattress in engagement with the friction strip.

DESCRIPTION OF THE PREFERRED EMBODIMENTS

Figure 1:
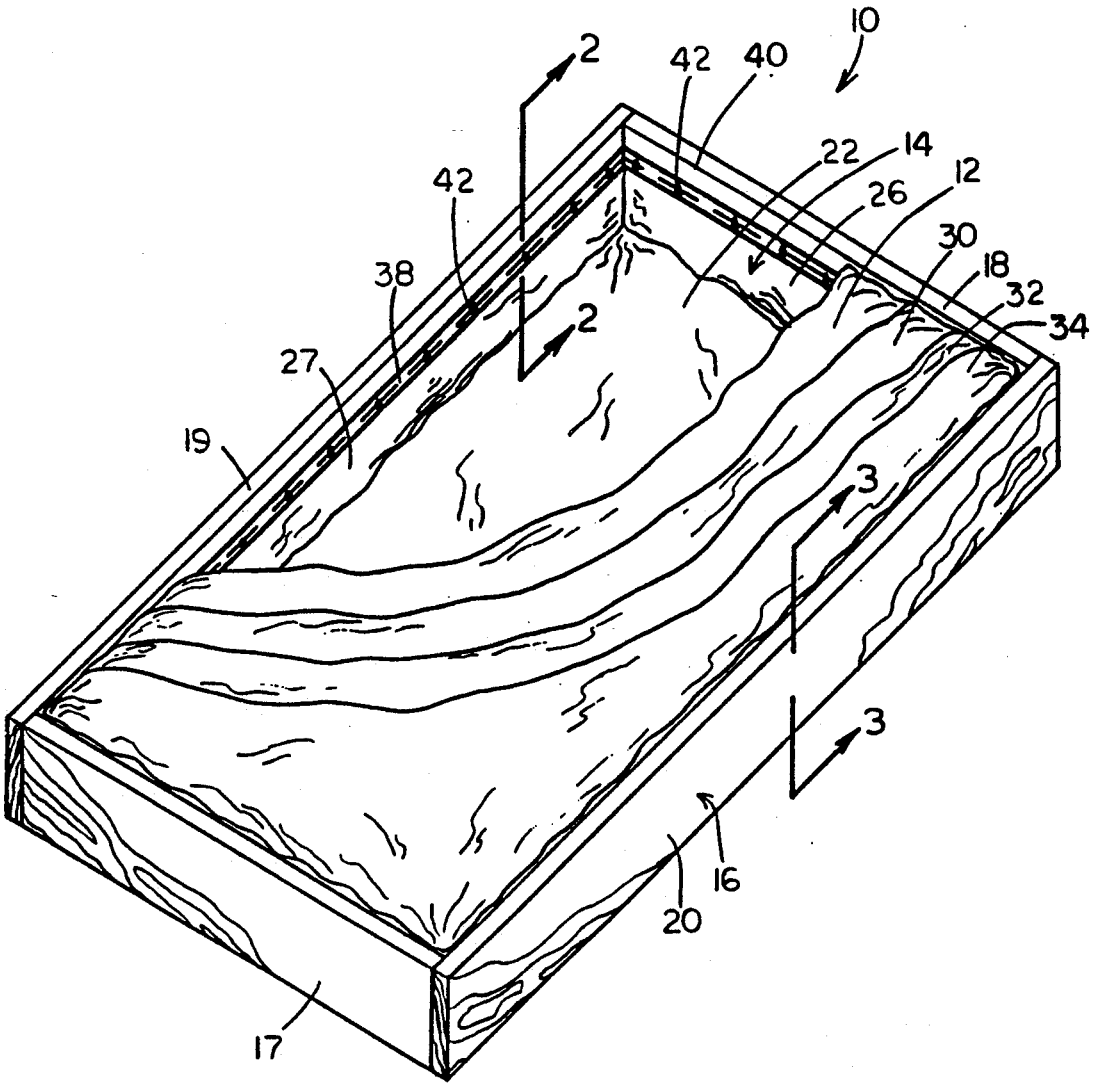
FIG. 1 is a perspective view of the friction strip of the invention installed on a waterbed having a standard liner, with portions of the mattress and bedding broken away to show the liner and friction strip.
Figure 2:
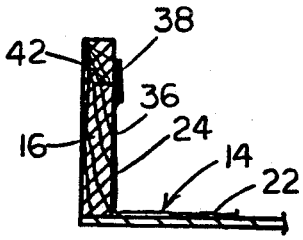
FIG. 2 is an enlarged sectional view taken along lines 2—2 in FIG. 1.
Figure 3:
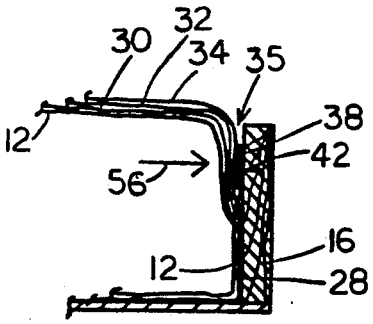
FIG. 3 is an enlarged sectional view taken along lines 3—3 in FIG. 1.

The bed covering securement system of the present invention is illustrated in FIGS. 1-3 in connection with a waterbed 10 having a mattress 12 supported in a liner 14 which, in turn, is supported on and within frame 16. Frame 16 is simply shown as a wooden box frame including end walls 17 and 18 and sidewalls 19 and 20.

Liner 14 is of the conventional standard type including a bottom wall 22 adapted to underlie the mattress 12 and a peripheral sidewall 24 including opposite end portions 25 and 26 and opposite side portions 27 and 28 which are connected together and to the bottom wall 22 to define a fluid tight or leakproof receptacle for the waterbed mattress 12. The generally single layer peripheral sidewall 24 is not self-supporting, but rather is generally secured to the frame sidewall 24 by staples or any other suitable means.

FIGS. 1-3 illustrate bed coverings including a bottom sheet 30, a top sheet 32 and a blanket or bedspread 34. These bed coverings are typically tucked in a slot formed between mattress 12 and liner 14 all around the bed. It is, therefore, the interior surface 36 of liner sidewall 24 that acts as the bed covering engagement surface.

To improve the retention of the bed coverings in that slot 35, a friction strip 38 is secured to the bed covering engagement surface 36 of liner sidewall 24, preferably at a position in adjacent spaced relation from the top edge 40 of the liner and frame. The friction strip 38 is formed of a shape and material such that the coefficient of friction between the strip 38 and bed coverings is greater than the coefficient of friction between the liner sidewall 24 and the bed coverings. Whereas the friction strip 38 is illustrated in a preferred embodiment as an elongated strip extending along the entire periphery of the bed covering engagement surface 36, the word "strip" does not imply an elongated shape. Rather, the friction strip could be provided as a series of spaced circular patches, spaced apart patches of any other shape or a series of several elongated strips of a length less than the length of either sidewall end portion 25 and 26. Likewise, whereas friction strip 38 is illustrated as a straight strip arranged parallel to the longitudinal direction of the peripheral sidewall 24, it could alternately have a sine wave configuration or any other shape which may give it more of a two-dimensional extent than a straight strip.

Figure 3A:
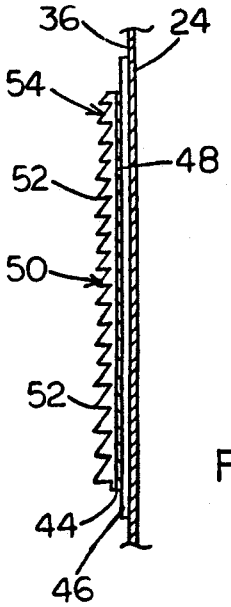
FIG. 3*a* is a partial side sectional view showing the liner side, the liner, and the friction strip with its sawtooth pattern.

In the embodiment of FIGS. 1-3, the friction strip 38 may be secured to the bed covering engagement surface 36 by the same staples 42, or other fasteners that are used for securing the liner sidewall to the frame. Alternatively, the friction strip may be first glued to the liner sidewall 24, or it may be adhered to a vinyl backing sheet by glue or other suitable fastening means, which backing sheet is heat sealed to the PVC material of the liner sidewall 24. FIG. 3A illustrates a friction strip 38 secured by adhesive 44 to a vinyl backing sheet 46 which is heat sealed along its peripheral edge to the liner sidewall 24.

FIG. 3A also illustrates a preferred cross-sectional shape for the friction strip 38. It is formed as an elongated strip having a flat side 48 for securement to the bed covering engagement surface 36 of liner sidewall 24 and an opposite roughened friction surface 50. The friction strip 38 may be extruded or otherwise formed so that the roughened friction surface 50 presents a plurality of longitudinally extended ridges 52, a preferred embodiment of which is the sawtooth configuration 54 illustrated in FIG. 3A. Those ridges could alternately be formed as the top curved surfaces of a sine wave pattern configuration or a series of raised patches of circular shape or any other shape. The ridges formed by the roughened friction surface 50 simply afford additional mechanical resistance to the grip of the friction strip material on the bed coverings engaged against the strip.

In operation, a waterbed 10 is made or covered in conventional fashion by first fitting bottom sheet 30 onto the mattress, followed by the top sheet 32 and a cover or bedspread 34. Those bed coverings are tucked in the slot 35 between the mattress 12 and bed covering engagement surface 36 of a liner sidewall 24. The force of the water in the waterbed mattress presses the bed coverings against the friction strip 38, thereby increasing the force required to dislodge the bed coverings from slot 35. That effect is explained by the laws of kinetic friction which state first that the force of kinetic friction between two surfaces is proportional to the normal force between the surfaces, and secondly, that the proportionality constant depends on the materials and roughness of the surfaces, but over a wide range, is independent of the area of contact of the surfaces and of the relative velocity of the surfaces. Normal force in the direction of arrow 56 in FIG. 3 is provided by the water in mattress 12. The roughness of the surface 50 is described above and the material of friction strip 38 is described as follows.

Friction strip 38 is preferably formed of a synthetic rubber-like compound. A suitable material is that commercially available under the trademark Kraton thermoplastic rubber. Kraton is believed to be a registered trademark of Shell Oil Company. The Kraton thermoplastic rubber is a unique synthetic polymer which combines the properties of vulcanized rubber with the processing advantages of conventional thermoplastics. The Kraton rubber Polymer has thermoplastic properties which allow it to soften and flow under heat and pressure and then recover its structure on cooling. Its elastomeric properties allow it to be stretched and then retract rapidly to its original shape. Kraton rubber's unique molecular structure is what gives it such a useful range of properties. Basically, its chemical make-up consists of three discrete blocks of the linear or A-B-A type: styrene-butadiene-styrene (S-B-S) for the Kraton D series. The A-B-A structure of the Kraton rubber molecule has polystyrene endblocks and an elastomeric midblock. After processing, the polystyrene endblocks physically crosslink, locking the rubber network in place. This gives Kraton rubber its high tensile strength which is comparable in performance to chemically cross-linked vulcanized rubber. Additionally, this physical cross-linking of Kraton rubber is reversible, when heated, allowing the recycling of rubber scraps. The friction strips formed of Kraton rubber compounds have physical properties similar to those of vulcanized elastomizer, but can be manufactured using thermoplastic processing techniques, such as molding, extrusion, or other forming techniques familiar to the thermoplastic industry.

Figure 4:
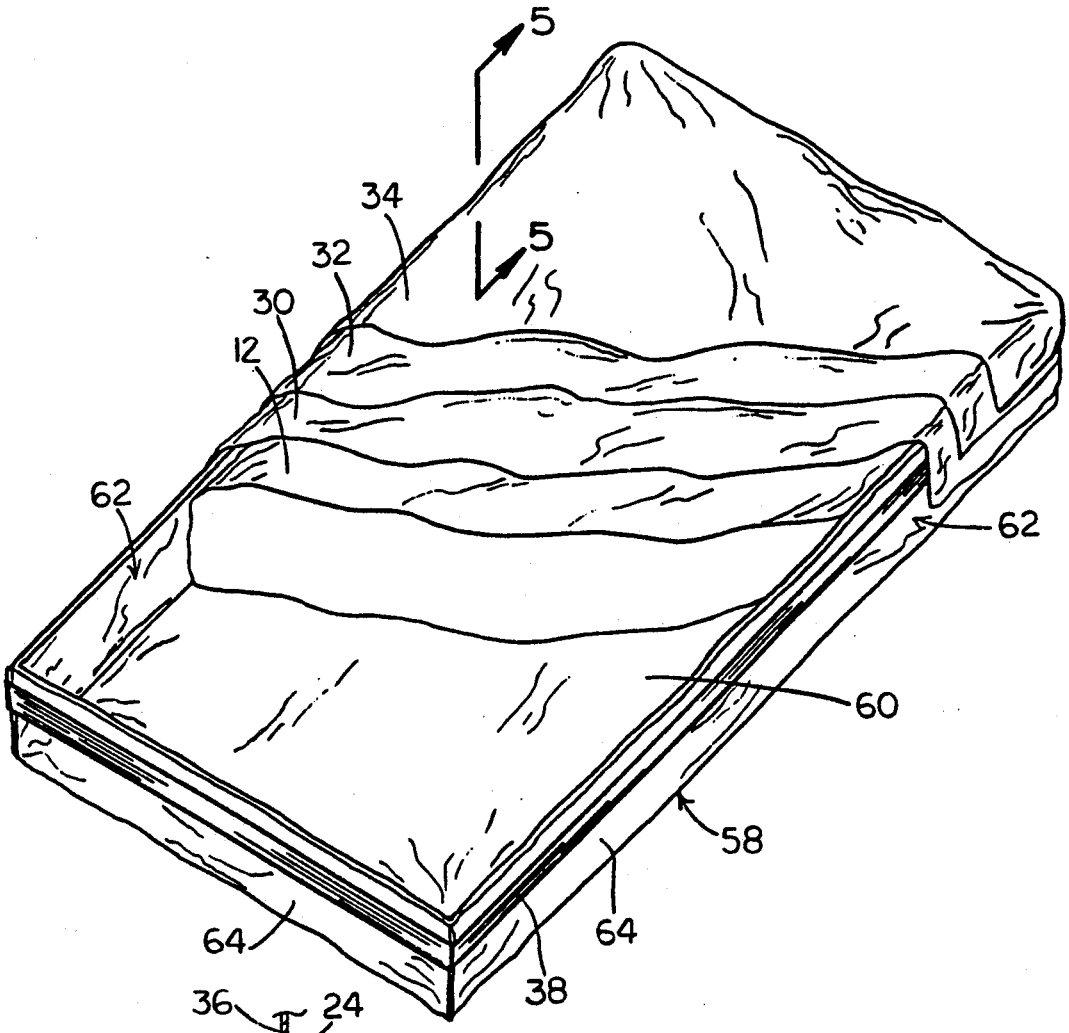
FIG. 4 is a perspective view of the friction strip of the invention on a waterbed mattress liner with stand-up sides, with portions of the mattress and bedding broken away for clarity.
Figure 5:
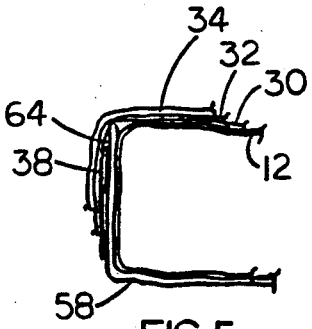
FIG. 5 is an enlarged sectional view taken along line 5—5 in FIG. 4.

FIGS. 4 and 5 illustrate the bed covering securement system of the invention in connection with a waterbed liner 58 of the type having stand-up sides. Liner 58 has the bottom wall 60 and a peripheral sidewall 62, generally formed as a double thickness wall with cardboard, foam, fiber, or some other filler interposed between interior and exterior layers of the sidewall. This type of liner affords thermal insulation to prevent heat loss through the sides of the bed. The bed coverings are typically inserted between the mattress 12 and liner sidewall 62 so that the interior surface 64 of sidewall 62 is the bed covering engagement surface to Which the friction strip 38 is secured, as discussed above. The water in mattress 12 presses against sidewall 62 which directs a normal force outwardly pressing friction strip 38 against the bed coverings 30-34 and surrounding frame, which may be of the rigid type illustrated in FIG. 1 or a softside mattress frame.

Figure 6:
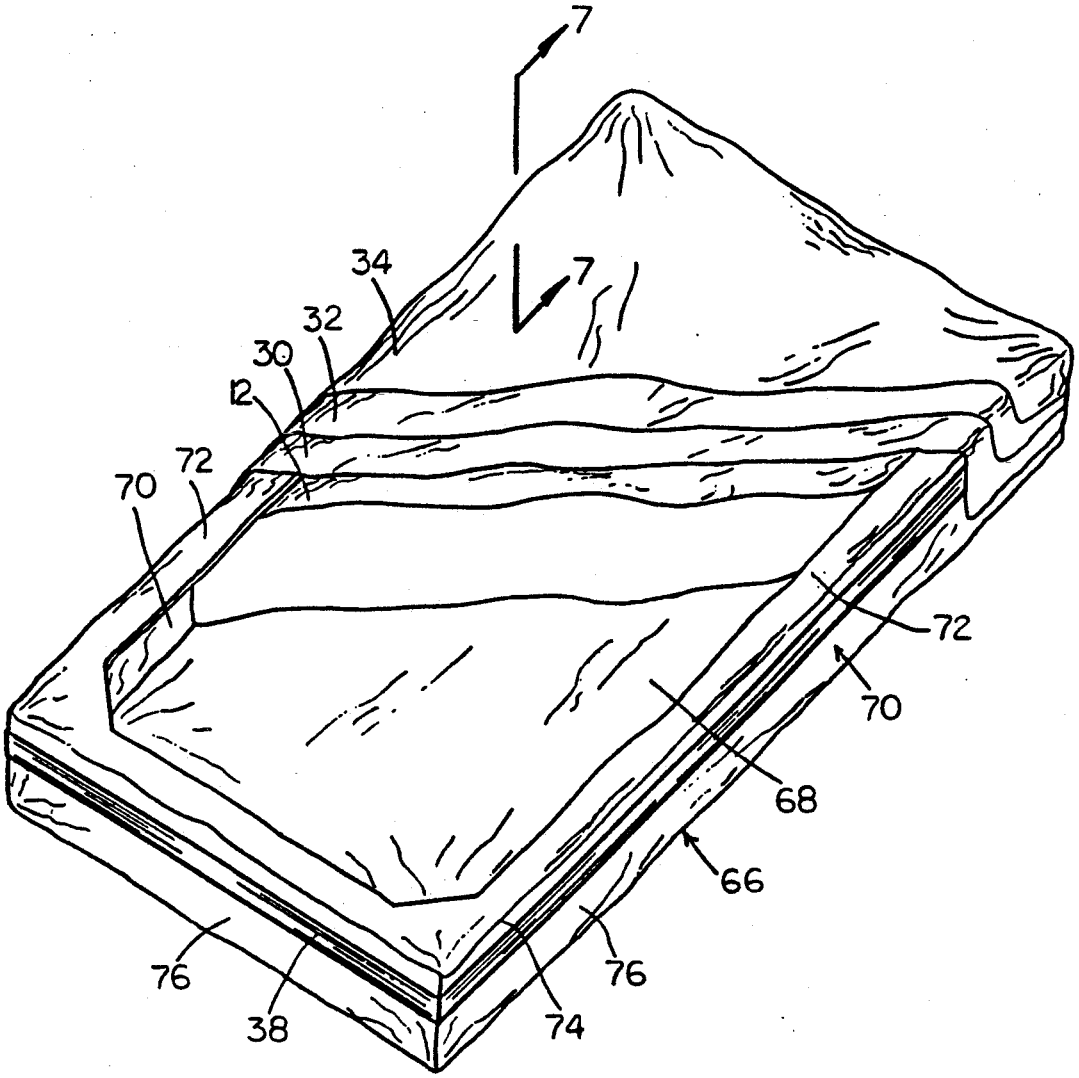
FIG. 6 is a perspective view of the friction strip of the invention installed on an envelope or contour liner in assembly relation with a waterbed mattress and bed coverings, portions of which are broken away for clarity.
Figure 7:
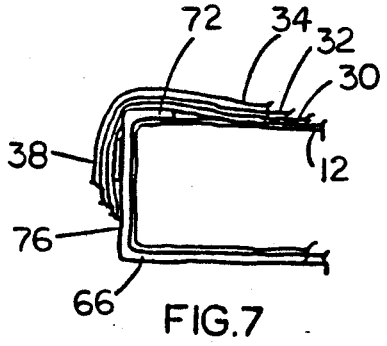
FIG. 7 is an enlarged partial sectional view taken along line 7—7 in FIG. 6.

FIGS. 6 and 7 illustrate another embodiment wherein the waterbed liner 66 is of the envelope or contour type including a bottom wall 68, a peripheral sidewall 70 and a top wall peripheral flange extending interiorly from the top edge 74 of the peripheral sidewall 70. Like the embodiment of FIGS. 4 and 5 it is the external surface 76 of sidewall 70 which acts as the bed covering engagement surface and to which the friction strip 38 is secured as discussed above.

It is apparent that the invention further contemplates a method of releasably securing bed coverings on a waterbed mattress including providing a friction strip of a shape and material such that the coefficient of friction between the strip and bed coverings is greater than the coefficient of friction between the sidewall and bed coverings, securing the friction strip to the bed covering engagement surface of the liner sidewall and fitting bed coverings onto the mattress in engagement with the friction strip.

Whereas the invention has been shown and described in connection with preferred embodiments thereof, it is apparent that many modifications, substitutions and additions may be made which are within the intended broad scope of the appended claims. For example, the length, width, thickness and shape of the friction strip material may be varied as desired for any particular application. Likewise, the invention is not limited to any particular means for fastening the friction strip in place for frictionally engaging bed coverings placed on the waterbed.

Thus there has been shown and described a bed covering securement system which accomplishes at least all of the stated objects.

I claim:

1. A waterbed mattress liner for releasably securing bed coverings on a waterbed mattress, comprising, a bottom wall adapted to underlie a waterbed mattress, a peripheral sidewall including opposite end portions and opposite side portions connected together and to said bottom wall to define a fluid-tight receptacle for a waterbed mattress, said peripheral sidewall including a peripheral bed covering engagement surface situated for contact with bed coverings to be fit onto a waterbed mattress lying on said liner, a friction strip of a shape and material such that the coefficient of friction between said strip and bed coverings is greater than the coefficient of friction between said sidewall and bed coverings, said friction strip comprising a synthetic rubber-like compound, and means for securing said friction strip to the bed covering engagement surface of said peripheral sidewall.

2. The waterbed mattress liner of claim 1 wherein said friction strip covers at least a portion of the length of the bed covering engagement surface of both end portions and both side portions of said peripheral sidewall.

3. The waterbed mattress liner of claim 2 wherein said friction strip comprises an elongated strip extended along the length of the sidewall portion to which it is secured.

4. The waterbed mattress liner of claim 3 wherein said friction strip extends along the full length of the bed covering engagement surface of said peripheral sidewall.

5. The waterbed mattress liner of claim 1 wherein said compound has a molecular structure, including three discrete blocks of the linear type: styrene-butadiene-styrene.

6. The waterbed mattress liner of claim 1 wherein said synthetic rubber-like compound is formed into an elongated strip having a flat engagement surface and an opposite roughened friction surface.

7. The waterbed mattress liner of claim 6 wherein the roughened friction surface of said friction strip has an elongated generally sawtooth pattern formed therein.

8. A waterbed mattress liner for releasably securing bed coverings on a waterbed mattress, comprising, a bottom wall adapted to underlie a waterbed mattress, a peripheral sidewall including opposite end portions and opposite side portions connected together and to said bottom wall to define a fluid-tight receptacle for a waterbed mattress, said peripheral sidewall including a peripheral bed covering engagement surface situated for contact with bed coverings to be fit onto a waterbed mattress lying on said liner, a friction strip of a shape and material such that the coefficient of friction between said strip and bed coverings is greater than the coefficient of friction between said sidewall and bed coverings, means for securing said friction strip to the bed covering engagement surface of said peripheral sidewall, and said peripheral sidewall comprising a single layer wall of a standard liner, the interior surface of which comprises the bed covering engagement surface.

9. A waterbed mattress liner for releasably securing bed coverings on a waterbed mattress, comprising, a bottom wall adapted to underlie a waterbed mattress, a peripheral sidewall including opposite end portions and opposite side portions connected together and to said bottom wall to define a fluid-tight receptacle for a waterbed mattress, said peripheral sidewall including a peripheral bed covering engagement surface situated for contact with bed coverings to be fit onto a waterbed mattress lying on said liner, a friction strip of a shape and material such that the coefficient of friction between said strip and bed coverings is greater than the coefficient of friction between said sidewall and bed coverings, means for securing said friction strip to the bed covering engagement surface of said peripheral sidewall, and said peripheral sidewall comprising an at least a two layer wall of a stand-up sidewall having interior and exterior surfaces, the interior surface of which comprises the bed covering engagement surface.

10. A waterbed mattress liner for releasably securing bed coverings on a waterbed mattress, comprising, a bottom wall adapted to underlie a waterbed mattress, a peripheral sidewall including opposite end portions and opposite side portions connected together and to said bottom wall to define a fluid-tight receptacle for a waterbed mattress, said peripheral sidewall including a peripheral bed covering engagement surface situated for contact with bed coverings to be fit onto a waterbed mattress lying on said liner, a friction strip of a shape and material such that the coefficient of friction between said strip and bed coverings is greater than the coefficient of friction between said sidewall and bed coverings, means for securing said friction strip to the bed covering engagement surface of said peripheral sidewall, and a peripheral top wall flange extended interiorly from the top edge of said peripheral sidewall, said sidewall having interior and exterior surfaces, the exterior surface of which comprises the bed covering engagement surface.

11. A method for releasably securing bed coverings on a waterbed mattress supported on a liner including a bottom wall and a peripheral sidewall connected together to define a leak-proof receptacle for the waterbed mattress, said peripheral sidewall having a bed covering engagement surface situated for contact with bed coverings to be fit onto said waterbed mattress, comprising providing a friction strip of a shape and material such that the coefficient of friction between said strip and bed coverings is greater than the coefficient of friction between said wall and bed coverings, said friction strip comprising a synthetic rubber-like compound, securing said strip to said bed covering engagement surface, and fitting bed coverings onto said mattress in engagement with said friction strip.

12. The method of claim 11 wherein said securing step comprises securing said friction strip to said peripheral sidewall along a substantial portion of the length thereof.

13. The method of claim 11 wherein said securing step further comprises positioning said strip at a medial position on said peripheral sidewall.

14. The method of claim 11 wherein said securing step comprises gluing said friction strip to said bed covering engagement surface.

* * * * *